US006279329B1

(12) United States Patent
Berge et al.

(10) Patent No.: US 6,279,329 B1
(45) Date of Patent: Aug. 28, 2001

(54) FLOW DIRECTOR SYSTEM

(75) Inventors: J. Eric Berge, Irvine; Mark A. McClure, Chino Hills, both of CA (US); David W. Goff, San Antonio, TX (US)

(73) Assignee: Lancer Icelink, L.L.C., Orange, CA (US)

( * ) Notice: Subject to any disclaimer, the term of this patent is extended or adjusted under 35 U.S.C. 154(b) by 0 days.

(21) Appl. No.: 09/549,768

(22) Filed: Apr. 14, 2000

(51) Int. Cl.[7] ..... F25C 1/00
(52) U.S. Cl. ..... 62/66; 62/344; 406/157
(58) Field of Search ..... 62/344; 406/97, 406/56, 153, 157, 158, 159, 160, 168, 169

(56) References Cited

U.S. PATENT DOCUMENTS 3,877,241 * 4/1975 Wade ..... 62/344
4,104,889 * 8/1978 Hoenisch ..... 62/344
4,264,243 * 4/1981 Bentzen-Bilkvist ..... 406/169
4,422,810 * 12/1983 Boring ..... 406/168
4,862,649 * 9/1989 Davis et al. ..... 406/169
5,207,073 * 5/1993 Maier-Laxhuber et al. ..... 62/269
5,660,506 * 8/1997 Berge et al. ..... 406/3

* cited by examiner

*Primary Examiner*—William E. Tapolcai
*Assistant Examiner*—Mohammad M. Ali
(74) *Attorney, Agent, or Firm*—Christopher L. Makay

(57) ABSTRACT

A flow director system for transporting ice to a desired locale includes a conduit system and a gas flow gate assembly coupled with the conduit system for directing ice to the desired locale along a desired path defined by the conduit system. The gas flow gate assembly includes a plurality of flow gates disposed along the conduit system and a flow gate controller linked with the plurality of flow gates, whereby the flow gate controller opens and closes the flow gates to route ice flow along the conduit system. In addition, the flow director system preferably includes an ice maker for delivering ice into an ice container. The ice container, in turn, includes a plurality of interface apertures for channeling ice from the ice maker to the conduit system. Moreover, in operation, a gas flow is established through the ice container between the interface apertures to prevent ice blockage about the ice container.

46 Claims, 4 Drawing Sheets

FLOW DIRECTOR SYSTEM

BACKGROUND OF THE INVENTION

1. Field of the Invention

The present invention generally relates to dispensing equipment and, more particularly, but not by way of limitation, to a system for transporting ice from an ice source to a remote location.

2. Description of the Related Art

To accommodate consumer needs for ice as a condiment for consumption with beverages, it is common in the beverage industry to incorporate an ice bin with a beverage dispenser system. Thus, ice and a desired beverage can either be accessed directly from the beverage dispenser system via the storage bin or from an ice dispenser unit in engagement with the storage bin of the beverage dispenser system.

Unfortunately, such beverage dispenser systems and ice dispenser units do not normally manufacture large quantities of ice to meet peak consumer demand, such as for example, peak hour demands at fast food restaurants or convenience stores. To satisfy large demands for ice, these systems currently feature either automatic ice makers of limited capacity or require manual replenishment by an attendant from a large-capacity ice maker. Although large-capacity ice makers are commercially available to satisfy peak demand, there currently exists no satisfactory means by which to transfer large quantities of ice from an ice maker to an ice storage bin.

Inasmuch, ice is potentially exposed to impurities and contaminants from the atmosphere and from consumers. Providing a continuous supply of ice has long been problematic, especially if the path between the ice bin and the ice maker becomes blocked. Often, a path is blocked by the very ice being transported.

Accordingly, there is a long felt need for a system for optimally transporting large quantities of ice to a remote location.

SUMMARY OF THE INVENTION

In accordance with the present invention, a flow director system for transporting ice to a desired locale includes a conduit system and a gas flow gate assembly coupled with the conduit system for directing ice to the desired locale along a desired path defined by the conduit system. The gas flow gate assembly includes a plurality of flow gates disposed along the conduit system and a flow gate controller linked with the plurality of flow gates, whereby the flow gate controller opens and closes the flow gates from the plurality of flow gates to route ice flow along the conduit system.

The flow director system preferably includes a plurality of ice discharge units, whereby each ice discharge unit is positioned at a different locale for delivering ice from the conduit system thereto. Additionally, the flow director system may include a drop-in ice bin for storing large quantities of ice, whereby the drop-in ice bin receives ice from the conduit system.

The flow director system preferably includes an ice maker for providing a supply of ice therefrom into an ice container, such as an ice trough, which transfers the ice from the ice maker to the conduit system. The ice trough includes an ice transport element, which is any suitable unbridging device, such as an auger, reversible auger, or paddle wheel, for delivering ice supplied from the ice maker into the conduit system.

The ice trough preferably includes a plurality of interface apertures for channeling ice from the ice trough to the conduit system. For example, the ice trough may include a first interface aperture and a second interface aperture in cooperative engagement with the first interface aperture. Thus, in operation, a gas flow is established across the ice trough between the first and the second interface apertures to enhance ice movement into the conduit system.

Furthermore, the flow director system includes a vacuum pump in cooperative engagement with the conduit system, whereby the vacuum pump and the gas flow gate assembly cooperatively apply a pump pressure, i.e. either a positive or a negative pressure, to the conduit system. The flow director system includes a filter in cooperative engagement with the conduit system for ensuring ice is not contaminated by the gas flow moving through the conduit system. The flow director system may further include a muffler in cooperative engagement with the vacuum pump.

In accordance with the present invention, a method for transporting ice to a desired locale includes forming a flow director system as described above. A plurality of flow gates is positioned along the conduit system and a flow gate controller is linked with the plurality of flow gates. As such, the flow gate controller opens and closes the flow gates to create a desired path for directing ice along the conduit system to a desired locale.

As discussed in part above, ice is channeled from an ice container, such as an ice trough, to the conduit system via the plurality of interface apertures. Inasmuch, for the above example, the gas flow across the ice trough between the first and second interface apertures is created by exerting a pump pressure on an active branch interface aperture, the first interface aperture. Thus, a gas flow may be established across the ice trough from the second interface aperture to the first interface aperture. Similarly, a gas flow may be established across the ice trough from the first interface aperture to the second interface aperture.

It is therefore an object of the present invention to provide a flow director system and associated method for transporting ice to a desired locale.

It is a further object of the present invention to provide an interface aperture and associated method for establishing a draft across an ice container of a flow director system to prevent ice blockage about that ice container.

It is yet a further object of the present invention to provide a gas flow gate assembly and associated method for directing ice along a designated path defined by a conduit system.

Still other objects, features, and advantages of the present invention will become evident to those skilled in the art in light of the following.

DETAILED DESCRIPTION OF THE PREFERRED EMBODIMENT

As required, detailed embodiments of the present invention are disclosed herein, however, it is to be understood that the disclosed embodiments are merely exemplary of the invention, which may be embodied in various forms, the figures are not necessarily to scale, and some features may be exaggerated to show details of particular components or steps.

Figure 1:
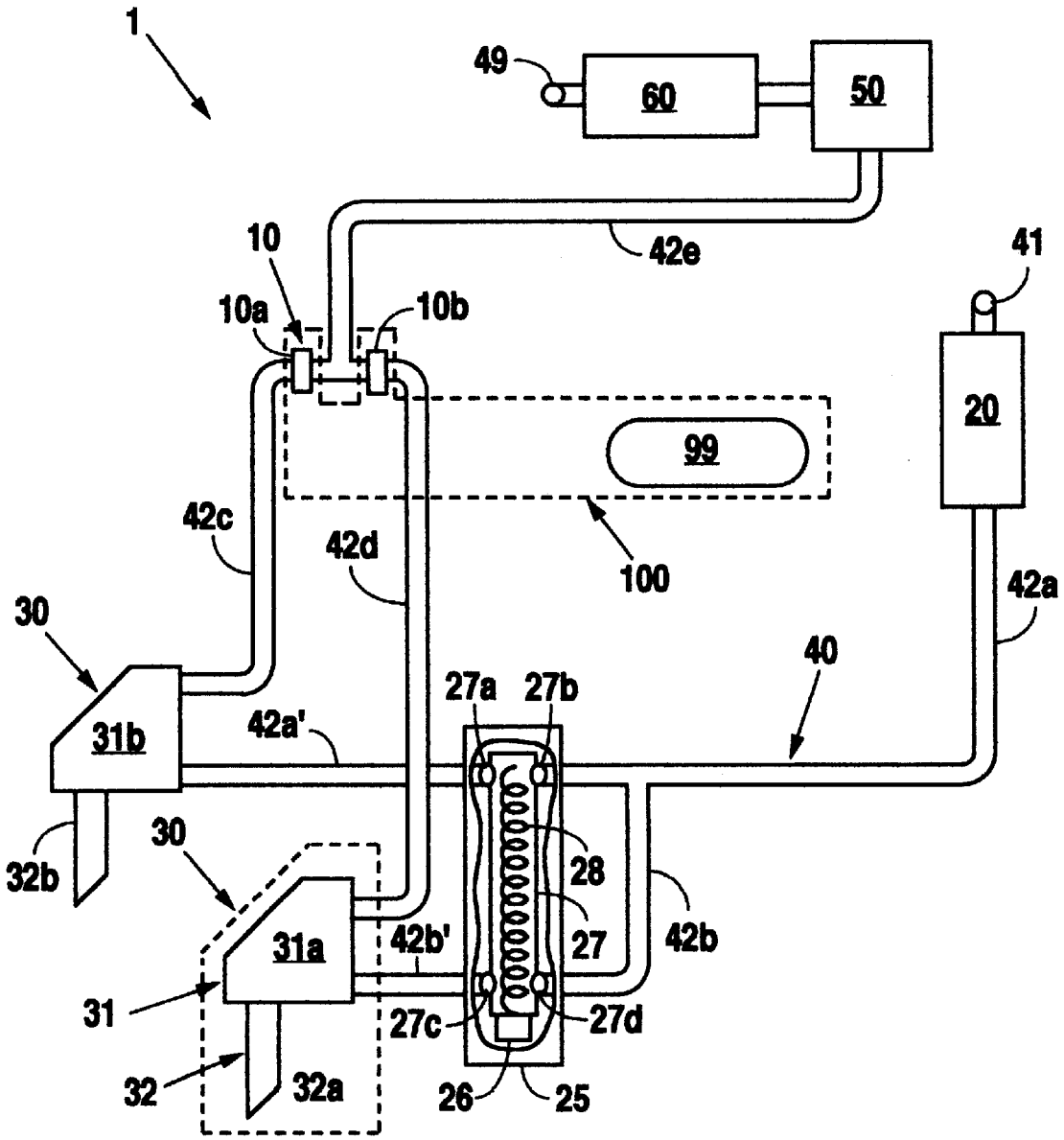
FIG. 1 is a plan view, including a partial cut-out, schematically illustrating a flow director system according to the preferred embodiment for transporting large quantities of ice to remote locations via a gas flow gate assembly.

FIG. 1 is a plan view illustrating a flow director system 1, as is preferred, for transporting ice to remote locations. Although ice is preferred, other material may be transferred by the flow director system 1 such as frozen foods, for example frozen meats and vegetables, wood shavings and other building materials, and waste material.

The flow director system 1 includes an ice maker positioned atop a suitable ice container, such as an ice trough 27, for providing a supply of ice therefrom into the ice trough 27. The ice maker 25 is of a standard type well known to those of ordinary skill in the art. In the preferred embodiment, the ice trough 27 includes an unbridging device as disclosed in U.S. patent application Ser. No. 09/364,794, entitled "Vacuum Pneumatic System for Conveyance of Ice" and assigned to Lancer Ice Link, LLC of Orange, Calif., incorporated herein by reference. Inasmuch, the ice trough 27 includes an ice transport element 28 for moving ice through the ice trough 27.

As shown in FIG. 1, the preferred ice transport element 28 is an auger although those of ordinary skill in the art will recognize alternative means for delivering ice, such as for example a paddle wheel or a conveyor belt. The auger permits ice to be continuously moved through the ice trough 27 with minimal potential for mechanical failure. Further, the pitch between the auger threads enables a predetermined amount of ice to be delivered therefrom.

In the preferred embodiment, an auger drive motor 26 is linked with the auger for turning the auger. The auger drive motor is preferably a reversible drive motor for turning the auger in one direction as well as in a reverse direction, such as a reversible drive motor disclosed in U.S. Pat. No. 5,660,506, entitled "Pneumatic Apparatus and Method for Conveyance of Frozen Food Items, assigned to Lancer Ice Link, LLC of Orange, Calif., incorporated herein by reference.

The flow director system 1 includes at least one ice discharge unit and, in this embodiment, includes a plurality of ice discharge units 30 for receiving ice from the ice maker 25. Each ice discharge unit 30 is positioned at a desired location so that ice may be delivered thereto.

In general, the ice discharge unit 30 includes a separator assembly 31 and a discharge interface 32 in operative engagement with and extending from the separator assembly 31. In the preferred embodiment, the separator assembly 31 includes a separator disclosed in U.S. patent application Ser. No. 09/364,794, entitled "Vacuum Pneumatic System for Conveyance of Ice" and assigned to Lancer Ice Link, LLC of Orange, Calif., incorporated herein by reference. As such, each discharge interface 32 is linked with an ice bin (not shown) from a beverage dispenser system or from an ice dispenser unit, whereby consumers can access ice from the ice bin, especially during peak demand.

The flow director system 1 includes a conduit system 40 for routing ice from the ice maker 25 to a desired locale. The conduit system 40 is preferably linked with a plurality of discharge units 30 as well as linked with the ice maker 25 for routing ice from the ice maker 25 to a desired discharge unit 30. In general, the conduit system 40 includes a receiving inlet 41 for drawing in gas. Normally the gas is ambient air although, under appropriate circumstances, carbon dioxide, nitrogen or argon is contemplated for conveying ice through the conduit system. Similarly, the conduit system 40 includes a dispensing outlet 49 for expending the gas from the conduit system 40.

Accordingly, the conduit system 40 is in cooperative engagement with the ice maker 25, thereby enabling gas drawn through the conduit system 40 to move the ice from the ice maker 25 to a desired ice discharge unit 30. Thus, the flow director system 1 uniquely moves ice through the conduit system 40 to a desired locale without the incorporation of additional ice transport elements, such as for example a diverter/air shifter disclosed in U.S. patent application Ser. No. 09/364,794, entitled "Vacuum Pneumatic System for Conveyance of Ice" and assigned to Lancer Ice Link, LLC of Orange, Calif. Continuous gas movement reduces ice delivery time to a desired locale as well as manufacturing costs.

The ice trough 27 preferably includes at least one interface aperture, illustratively shown in FIG. 1 as four interface apertures 27*a–d*. Each interface aperture is linked with a designated segment or "branch" of the conduit system 40 for routing ice to a desired locale. Generally, a series of branches from the conduit system 40 ultimately define a path for routing ice to the desired locale. In short, each aperture from the ice trough 27 routes ice to a designated locale via a corresponding branch linked thereto.

Operatively, as discussed in detail below, a pump pressure is exerted through a series of branches to thus route ice through a path, whereby a branch from the series of branches that is coupled with and actively receives a pump pressure is defined and used in this description as an "active branch". Accordingly, by definition and use in this description, the active branch is respectively linked with and in communication with an "active branch interface aperture", whereby ice is directed from the ice trough 27 through the active branch interface aperture to the active branch.

Inasmuch, all other branches coupled with the ice trough 27 and corresponding interface apertures are defined and used in this description as "passive branches" and "passive branch interface apertures", respectively. In other words, a pump pressure, while being applied to an active branch and active branch interface aperture, is not applied to a passive branch and a corresponding passive branch interface aperture.

In addition, the conduit system 40 preferably moves gas through the ice trough 27 to prevent unfavorable ice blockage of the interface apertures 27*a–d*. A blocked interface aperture promotes unfavorable accumulation of ice within the ice trough 27, thereby potentially hindering the operation of or even catastrophically damaging the ice transport element 28, the auger drive motor, and the ice trough 27 itself.

For example, because there is a strong likelihood of residual ice from the ice maker 25 accumulating along the ice trough 27, interface apertures preferably positioned adjacent to the ice maker 25, interface apertures 27c and 27d in FIG. 1, and about the ice trough 27, interface apertures 27*a* and 27*b* in FIG. 1, moves residual ice away from the areas of the ice trough 27 susceptible to a blocked interface aperture 27*a–d* as described above. Operatively, a pump pressure is applied to an active branch interface aperture to establish a gas flow or, simply, a "draft" across the ice trough 27 to prevent unfavorable accumulation of ice about the ice trough 27.

Illustratively, consider dispensing ice from discharge interface 32*a* of FIG. 1, a pump pressure is applied to active branch 42*b*', thereby establishing gas flow across the ice trough 27 between interface aperture 27*c*, the active branch interface aperture, and interface apertures 27*a*, 27*b*, and 27*d*, the passive branch interface apertures. Thus, gas flows through the ice trough 27 from interface apertures 27*a*, 27*b*, and 27*d* to interface aperture 27*c* as discussed in greater detail below.

The flow director system 1 includes at least one filter unit 20 in cooperative engagement with the conduit system 40 for filtering out unfavorable contaminants and particulates from the gas to ensure that the ice is not contaminated therefrom as the gas moves the ice through the conduit system 40. In the preferred embodiment, the filter unit 20 is positioned adjacent receiving inlet 41.

Referring to FIG. 1, the flow director system 1 includes vacuum pump 50 in cooperative engagement with the conduit system 40 for channeling gas through the conduit system 40. As discussed in detail below, the flow director system 1 includes a gas flow gate assembly 100, preferably in cooperative engagement with the vacuum pump 50 and the conduit system 40, whereby the vacuum pump 50 and the gas flow gate assembly 100 cooperatively exert a pump pressure across the conduit system 40. The vacuum pump 50 preferably comprises a standard vacuum pump of a type well know in the industry for providing a pump pressure, either a continuous positive or negative pressure during operation.

In operation, a negative pressure is preferably applied by the flow director system 1 for routing ice through the conduit system 40. As such, a negative pressure draws ice along the conduit system 40. Additionally, a muffler 60 may be provided along the conduit system 40, in cooperative engagement with the vacuum pump 50, for acting against unfavorable noise arising from the discharge of gas from the flow director system 1.

Although the vacuum pump 50 for the embodiment of FIG. 1 preferably routes ice with a negative pressure, other embodiments contemplate routing ice with a positive pressure to a desired locale. A positive pressure thus pushes ice along the conduit system 40. For the more complex embodiments of FIGS. 2 and 3, however, the flow director system 1 routes ice with positive as well as negative pressure. Accordingly, as discussed in detail below, the gas flow gate assembly 100 includes a router 111 in cooperative engagement with the vacuum pump 50 to route ice with positive as well as negative pressure.

Figure 2:
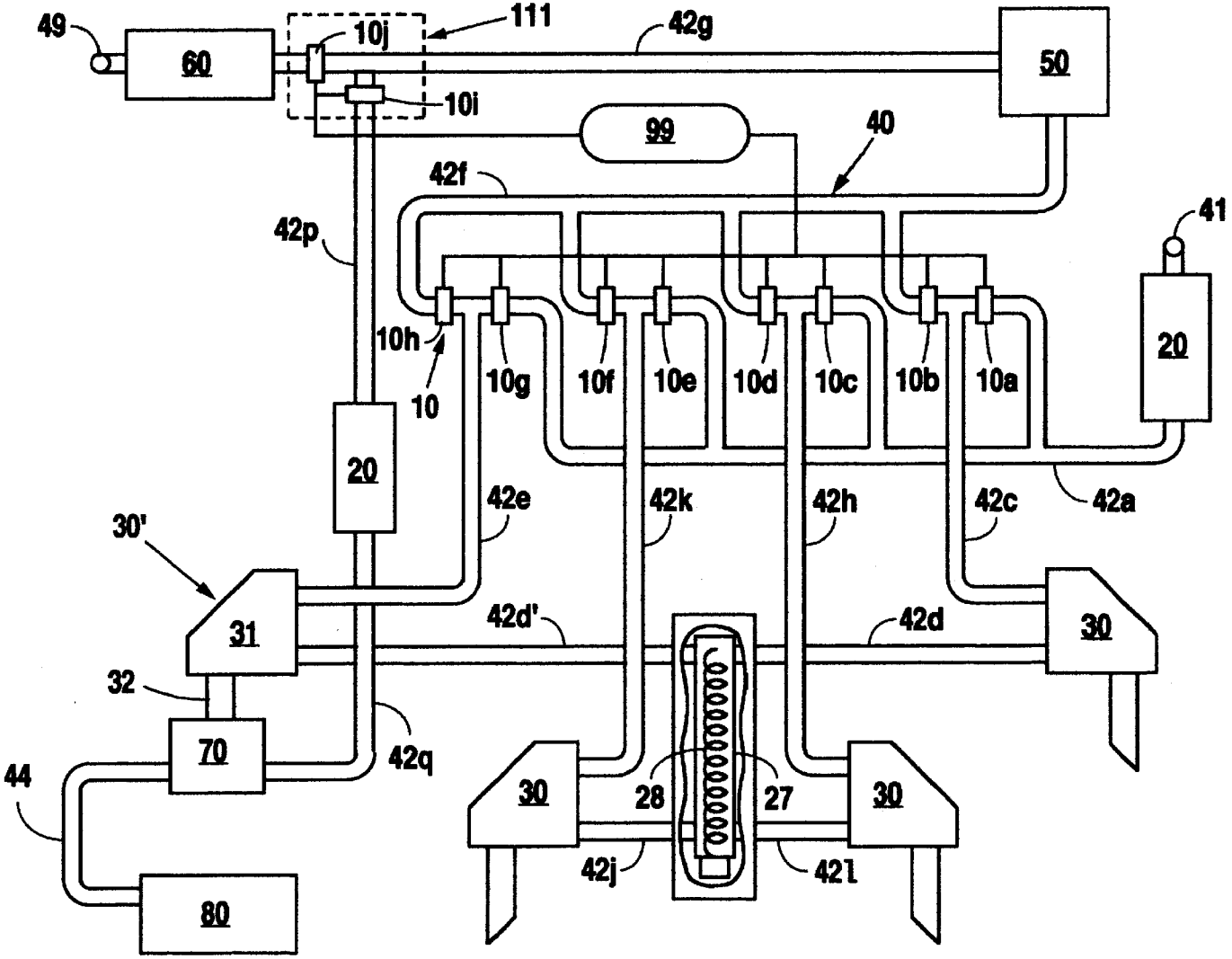
FIG. 2 is a plan view, including a partial cut-out, schematically illustrating another embodiment of a flow director system featuring a pressure converter to accommodate delivery of ice to a drop-in ice bin.
Figure 3:
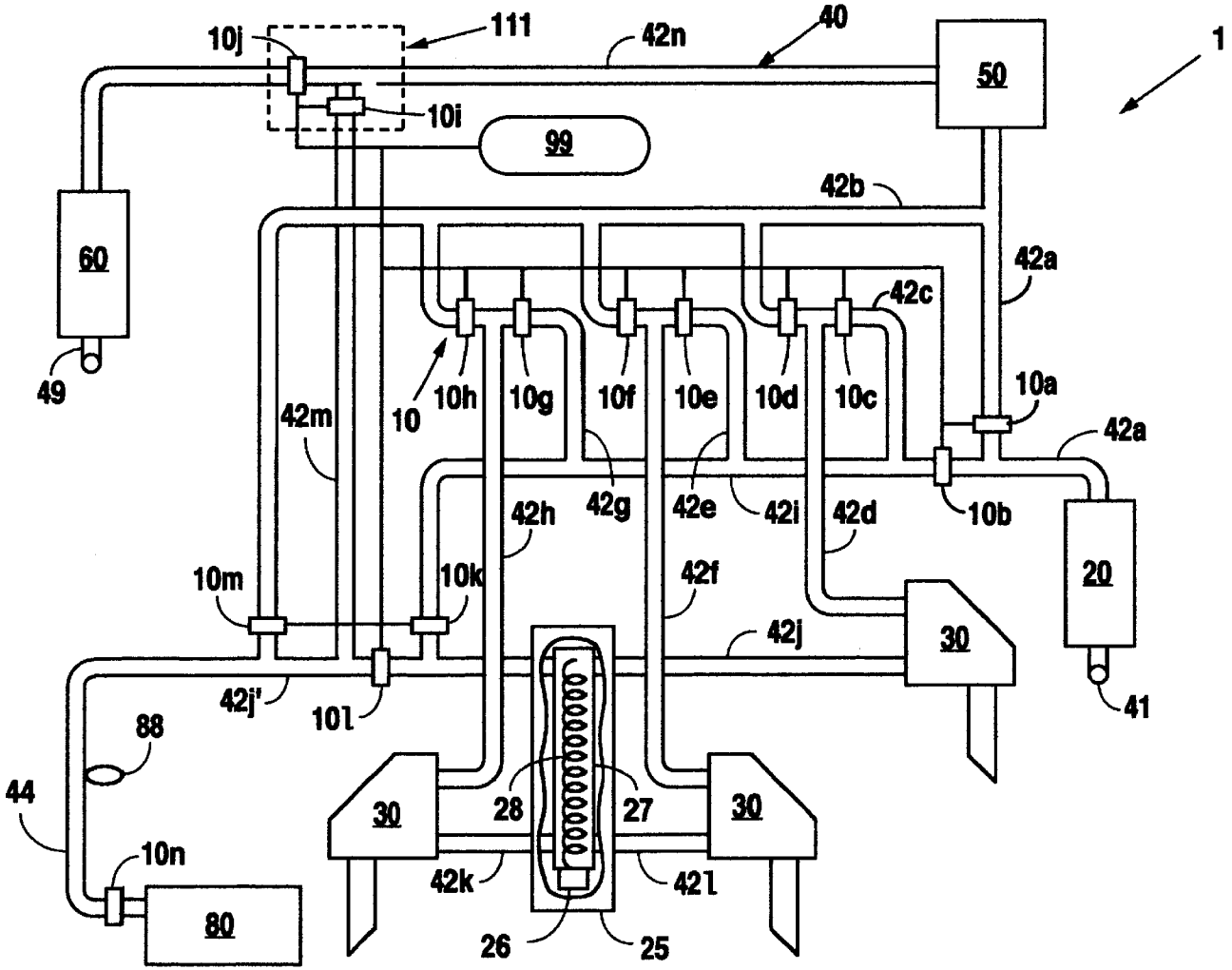
FIG. 3 is a plan view, including a partial cut-out, schematically illustrating a further embodiment of a flow director system featuring a pulse timing sequence to accommodate delivery of ice to a drop-in ice bin.

Furthermore, for the embodiments of FIGS. 2 and 3, the flow director system 1 includes a drop-in ice bin 80 disposed along and in cooperative agreement with the conduit system 40. Inasmuch, for the embodiments of FIGS. 2 and 3, ice is preferably fed horizontally into a drop-in ice bin 80, although those of ordinary skill in the art will readily recognize other spatial directions by which to discharge ice into a drop-in ice bin. For example, unlike beverage dispenser or ice dispenser systems, the industry commonly places drop-in ice bins in backrooms away from the customer due to their larger size and greater ice storage capacity. A "branch" from the conduit system 40 is typically run horizontally thereto, hence facilitating horizontal ice feed into a drop-in ice bin.

The drop-in ice bin 80 includes a drop-in ice bin of a type well known in the industry. Because discharge units are typically linked with ice bins of limited capacity from either a beverage dispenser system or from an ice dispenser unit, a drop-in ice bin is contemplated for accommodating needs for larger ice capacity.

Referring to the embodiment of FIG. 2, the flow director system 1 includes a pressure converter 70 disposed along the conduit system 40 in cooperative engagement with the drop-in ice bin 80. The pressure converter 70, via a branch 44 from the conduit system 40, facilitates horizontal ice feed from the ice discharge unit 30 to a drop-in ice bin 80. In the preferred embodiment, the pressure converter 70 comprises an air lock device as disclosed in U.S. patent application Ser. No. 09/364,794, entitled "Vacuum Pneumatic System for Conveyance of Ice" and assigned to Lancer Ice Link, LLC of Orange, Calif., incorporated herein by reference.

In operation, the flow director system 1 applies a negative pressure to draw ice from the ice trough 27 across the conduit system 40 to an ice discharge unit 30 at a desired locale. As such, the separator assembly 31 of each ice discharge unit 30 is preferably linked with the conduit system 40 so that a pump pressure is consistently maintained about various branches of the conduit system 40 that define a desired path for ice flow through the separator assembly 31 to a corresponding discharge interface 32 for discharge therefrom. Preferably, in FIG. 2, a negative pressure is operatively maintained about branches 42*a*, 42*b*, 42*c*, 42*d*, 42*e*, 42*f*, 42*h*, 42*i*, 42*j*, and 42*k* to thus define a path for drawing ice to a discharge unit 30 or a drop-in ice bin 80. A positive pressure is thus operatively maintained about branches 42*g* to define a path for exhausting gas from the flow director system 1, or, alternatively, a positive pressure is operatively maintained about branches 42*g*, 42*p*, and 42*q* to define a path for exhausting gas into the converter 70.

Illustratively, consider where an ice discharge unit 30', via the branch 44, is operatively engaged with a drop-in ice bin 80. Because ice typically enters the drop-in ice bin 80 horizontally at a side of the drop-in ice bin 80, an ice stream discharged from the discharge interface 32 at negative pressure must be subjected to positive pressure to thus successfully discharge ice into the drop-in ice bin 80.

Accordingly, the pressure converter 70, in cooperative engagement with the discharge interface 32, subjects the ice stream to a positive pressure for discharge into the drop-in ice bin 80. In particular, the branch 44 is normally at atmospheric pressure to accommodate the ice stream after passing through the pressure converter 70. However, to thus favorably discharge ice into the drop-in ice bin 80, the branch 44 is subjected to a positive pressure so as to move the ice thereacross.

Referring to the embodiment of FIG. 3, which is unlike the configuration of FIG. 2 where various branches from a desired path maintain either a positive or a negative pressure to ultimately pass ice therethrough to accommodate the converter 70, the vacuum pump 50 and the gas flow gate assembly 100 apply in combination either a positive or a negative pressure across a desired path from the conduit system 40. Moreover, for the configuration in FIG. 3, ice is discharged into the drop-in ice bin 80 without an ice discharge unit 30. Operatively, the flow director system 1 applies a negative pressure to draw ice from the ice trough 27 across a desired path defined by the gas flow gate assembly 100 and the conduit system 40 to an ice discharge unit 30 at a desired locale.

In the preferred embodiment of FIG. 3, the flow director system 1 utilizes a pulse timing sequence to facilitate the delivery of ice to the drop-in ice bin 80 of FIG. 3. Accordingly, the flow director system 1, via the gas flow gate assembly 100 and the vacuum pump 50, switches under a pulse timing sequence from a negative pressure to a positive pressure to route ice across the branch 44.

Illustratively, for discharge to the drop-in ice bin 80, the auger activates for a first predetermined time period (5 seconds in this embodiment), while the vacuum pump 50 applies a negative pressure to draw ice from the ice trough 27 across a desired path from the conduit system 40. At the expiration of the first predetermined time period, the auger deactivates and the flow director system 1 switches for a second predetermined time period (5 seconds in this embodiment) from applying a negative pressure to applying a positive pressure across the desired path, thereby discharging the ice into the drop-in ice bin 80. Upon the expiration of the second predetermined time period, the flow director system 1 returns to the delivery of ice across a desired path from the conduit system 40. The foregoing pulse timing sequence repeats until the flow director system 1 delivers a desired amount of ice into the drop-in ice bin 80 or until an overall bin fill time period expires.

Alternatively, the flow director system 1 in FIG. 3 may include a detector 88, disposed along the branch 44 and in operative engagement with the vacuum pump 50 and the gas flow gate assembly 100, for determining a favorable quantity of ice along the branch 44 and for generating a signal thereof. Accordingly, the flow director system 1, via the gas flow gate assembly 100 and the vacuum pump 50, switches from a negative pressure to a positive pressure to route ice across the branch 44 responsive to the signal output by the detector 88. Illustratively, for discharge to the drop-in ice bin 80 of FIG. 3, the vacuum pump 50 first applies a negative pressure to draw ice from the ice trough 27 across a desired path from the conduit system 40. The detector 88 emits a signal signifying that a favorable quantity of ice has accumulated along the conduit system 40. The flow director system 1, responsive to the signal, switches from applying a negative pressure to applying a positive pressure across the desired path, thereby discharging the ice into the drop-in ice bin 80.

Of note in FIGS. 1–3, the flow director system 1 includes the gas flow gate assembly 100, as is preferred, for directing an ice stream along a designated path defined by the conduit system 40. The gas flow gate assembly 100 includes a plurality of flow gates 10 in cooperative engagement with one another for restricting flow along the conduit system 40, thereby routing the ice stream along a desired path. In the embodiments of FIGS. 1–3, the flow gates 10 comprise valves of a type well known in the industry for restricting ice flow across a conduit system, such as commercially available pneumatic or electric gate valves.

In effect, each flow gate 10 is placed along the conduit system 40 to, thus, divide the conduit system 40 into various branches, whereby the ice stream is channeled through a designated branch for discharge to a desired locale. The use of a plurality of flow gates 10 allows for the gas flow gate assembly 100 to be conveniently reconfigured when desired, thereby creating new branches for new locales and eliminating old undesired branches. Those of ordinary skill in the art will readily recognize various configurations for a gas flow gate assembly and corresponding conduit system to accommodate varying ice demand so long as the flow gates 10 work in cooperative engagement to channel an ice stream through a designated branch for discharge to a desired locale. Inasmuch, the flow director systems 1 of FIGS. 2 and 3 incorporate the elements of the flow director system 1 of FIG. 1 and further integrate different elements, such as for example more ice discharge units 30 as well as a drop-in ice bin 80 to accommodate varied ice demand, yet each flow gate 10 works cooperatively with another to route ice along a designated path defined by that conduit system.

Each flow gate 10 is readily controlled by a flow gate controller 99 linked thereto. Specifically, the flow gate controller 99 opens and closes each flow gate 10 throughout the conduit system 40 via a control signal emitted therefrom and received by each flow gate 10, thereby selectively creating a desired path for ice flow from the ice trough 27 to a desired locale.

The flow gate controller 99 preferably comprises an electronic controller, such as a microprocessor and associated circuitry or a computer using conventional or custom designed computer software. Additionally, the flow gate controller 99 is connected by appropriate circuitry to sensors, such as conventional sensors and pump controls, for routing ice through a designated branch of the conduit system 40.

Particularly, the flow gate controller 99 may be linked with the detector 88 and with the vacuum pump 50. The flow gate controller 99 thus receives a signal from the detector 88, opens and closes respective flow gates 10 to create a desired path for ice flow, and activates the vacuum pump 50 to route ice through that path.

The gas flow gate assembly 100 of FIGS. 2 and 3 includes the router 111 for routing ice with a positive as well as a negative pressure. Although those of ordinary skill in the art will recognize other means for routing ice with positive as well as negative pressure, the router 111 is preferably defined by a plurality of flow gates in cooperative engagement with the conduit system 40, shown in the embodiments of FIGS 2 and 3 as flow gates 10*i* and 10*j*.

Operatively, for FIGS. 2 and 3, the vacuum pump 50 exhausts gas from the conduit system via branch 42*g* and 42*n*, respectively. Accordingly, to apply a negative pressure to a desired path, flow gate 10*j* is opened and flow gate 10*i* is closed, thereby exhausting gas from the dispensing outlet 49. To apply a positive pressure to a desired path, such as for example to route ice to the drop-in ice bin 80, exhaust gas from branch 42*g* and 42*n*, respectively, is routed to the desired path so as to induce a positive pressure. As such, flow gate 10*j* is closed and flow gate 10*i* is opened.

Illustratively, to operate the flow director system 1 of FIG. 1 so that ice passes through the discharge interface 32*a*, the gas flow gate assembly 100 creates a desired path across the conduit system 40. The flow gate controller 99 opens flow gate 10*b* and closes flow gate 10*a* to establish the desired path. Accordingly, the flow director system 1 applies a negative pressure, via the vacuum pump 50 and the gas flow gate assembly 100, to draw gas from the receiving inlet 41, across the filter unit 20, across the branches 42*a*, 42*a*', 42*b*, 42*b*', 42*d*, and 42*e*, and out dispensing outlet 49. Ice is thus drawn from the ice trough 27 through interface aperture 27*c* in cooperative engagement with branch 42*b*' and carried to the separator 31*a*. As a result of a negative pressure actively applied at interface aperture 27*c*, gas flow from the branches 42*a*, 42*a*', and 42*b* is carried through the ice trough 27 from interface apertures 27*a*, 27*b*, and 27*d*, the passive branch interface apertures, toward the interface aperture 27*c* to prevent damage of the ice trough 27 as discussed above.

In a similar manner, to pass ice through the discharge interface 32*b* of FIG. 1, the flow gate controller 99 closes flow gate 10*b* and opens flow gate 10*a* to establish a desired path. The flow director system 1 thus applies a negative pressure to draw gas from the receiving inlet 41, across the filter unit 20, across the branches 42*a*, 42*b*, 42*b*', 42*a*', 42*c*, and 42*e*, and out the dispensing outlet 49. Ice is drawn from the ice trough 27 through interface aperture 27*a* in cooperative engagement with 42*a*' and carried to separator 31*b*.

Additionally, gas flow is preferably carried through the ice trough 27 from the interface apertures 27*b*, 27*c*, and 27*d* toward the interface aperture 27*a*, the active branch interface aperture.

Illustratively, continuing the above example for the flow director system 1 of FIG. 2 wherein ice is discharged to the drop-in ice bin 80, the flow gate controller 99 closes the flow gate 10*j* and opens flow gates 10*h* and 10*i* in addition to the flow gate 10*a*. As such, the flow director system 1 exerts a pump pressure on the gas to thus implement a negative pressure from the receiving inlet 41, across filter unit 20, and across branches 42*a*, 42*b*, 42*c*, 42*d*, 42*d*', 42*e*, and 42*f*, thereby exerting a positive pressure across 42*g*, 42*p*, and 42*q* and into the converter 70.

In addition, gas flow is preferably passed through the ice trough 27 to prevent damage thereto. As such, the flow controller 99 opens flow gates 10*c* and 10*e* to channel gas flow through ice trough 27. Gas flow is thus channeled from branch 42*a* through branches 42*h* and 42*i* as well as through branches 42*k* and 42*j*, through ice trough 27, and out branch 42*d*' into separator assembly 31. Moreover, to maintain this ice flow to the drop-in ice bin 80, the flow controller 99 closes flow gates 10*b*, 10*d*, 10*f*, and 10*g*, thereby establishing the desired path. Although the foregoing describes the delivery of ice into the drop-in bin 80, those of ordinary skill in the art will readily recognize that ice delivery into one of the separator assemblies 30 involves an operation similar to that described with reference to FIG. 1, whereby the flow gate controller 99 opens and closes appropriate ones of the flow gates 10*a*–*j* to establish a desired flow path through the conduit system 40.

Illustratively, continuing the above example for the flow diverter system 1 of FIG. 3 wherein ice is discharged to the drop-in ice bin 80, the flow gate controller 99 opens flow gates 10*b*, 10*c*, 10*e*, 10*g*, 10*l*, and 10*m*. As such, the flow director system 1 particularly draws a negative pressure from the receiving inlet 41, across filter unit 20, across branches 42*a*, 42*i*, 42*c*, 42*d*, 42*e*, 42*f*, 42*g*, 42*h*, 42*k*, 42*l*, 42*j*, 42*j*', and 42*b* toward the branch 44. In addition, the auger activates for a first predetermined time period (5 seconds in this embodiment).

In preventing damage to the ice trough 27, gas flow is preferably channeled from branch 42*a* through branches 42*d* and 42*j*, through branches 42*h* and 42*k*, and through branches 42*f* and 42*l*, through ice trough 27, and out branch 42*j*'. Accordingly, the flow gate controller 99 opens flow gates 10*b* as well as 10*c*, 10*e*, and 10*g* to direct gas flow to the ice trough 27. Although gas flow is applied to the ice trough 27 in conjunction with ice delivery operations across the conduit system 40, other embodiments for FIGS. 2 and 3 contemplate damage preventing operations for the ice trough 27 performed independently from ice delivery operations of the conduit system 40. In that instance, flow gate 10*a* would be opened and flow gate 10*b* is closed to eliminate gas flow through the separator assemblies 30.

Furthermore, to discharge ice into the drop-in ice bin 80, the auger deactivates at the expiration of the first predetermined time period, and the flow director system 1 exerts a positive pressure for a second predetermined time period (5 seconds in this embodiment) across the desired path described above to discharge the ice into the drop-in ice bin 80. As such, the flow gate controller 99 opens the flow gates 10*i* and 10*n* as well as closes the previously opened flow gates for the second predetermined time period to thus direct a positive pressure toward the drop-in ice bin 80, thereby delivering the ice thereto. Upon the expiration of the second predetermined time period, the flow gate controller 99 closes the flow gates 10*i* and 10*n* and opens the above flow gates, thereby returning to the delivery of ice toward the branch 44. The above sequence repeats until the flow director system 1 delivers a desired amount of ice into the drop-in ice bin 80 or until an overall bin fill time period expires. The foregoing describes the delivery of ice into the drop-in bin 80, nevertheless, those of ordinary skill in the art will readily recognize that ice delivery into one of the separator assemblies 30 involves an operation similar to that described with reference to FIG. 1, whereby the flow gate controller 99 opens and closes appropriate ones of the flow gates 10*a*–*n* to establish a desired flow path through the conduit system 40.

Figure 4:
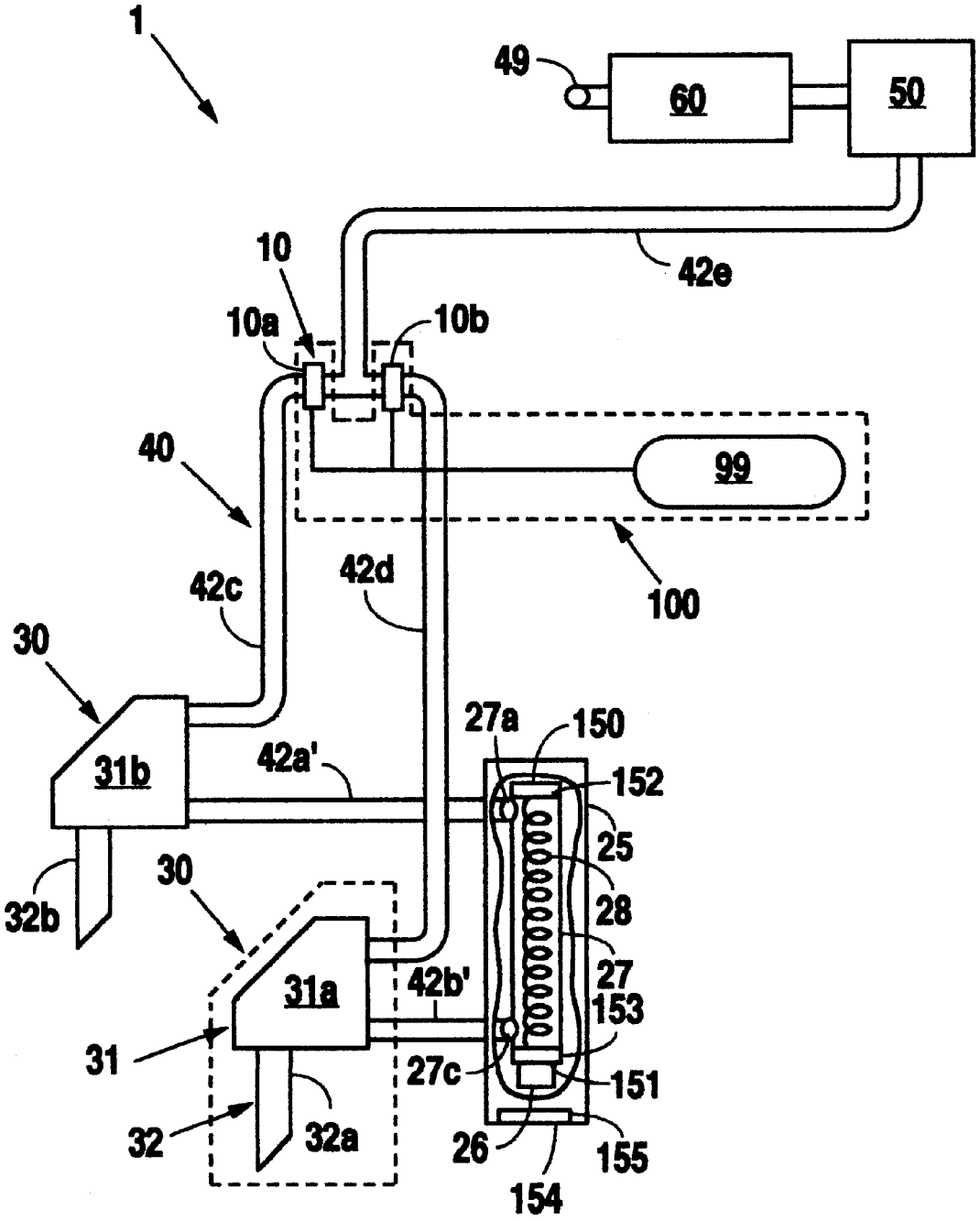
FIG. 4 is a plan view, including a partial cut-out, schematically illustrating still another embodiment of a flow director system featuring an alternative gas flow configuration.

Referring to the embodiment of FIG. 4, the flow director system 1 has been reconfigured to save space and lower cost through the elimination of the branch 42*a*, which includes the interface aperture 27*b*, the receiving inlet 41, and the filter unit 20, and the branch 42*b*, which includes the interface aperture 27*d*. The flow diverter system 1 of FIG. 4 operates identically to the flow director system 1 of FIG. 1, except that gas does not flow into the ice trough 27 from the interface apertures 27*b* and 27*d* due to the elimination of the branches 42*a* and 42*b*.

To ensure sufficient gas flow to draw ice from the ice trough 27, the ice trough 27 includes an opening 150 therethrough, which permits gas flow into the ice trough 27 upon the engagement of the vacuum pump 50. The opening 150 is fitted with a filter 152 for filtering out unfavorable contaminants and particulates from the gas to ensure that the ice is not contaminated therefrom as the gas moves the ice through the conduit system 40. Similarly, the ice trough 27 may also include an opening 151 therethrough, which permits gas flow into the ice trough 27 upon the engagement of the vacuum pump 50. The opening 151 is fitted with a filter 153 for filtering out unfavorable contaminants and particulates from the gas to ensure that the ice is not contaminated therefrom as the gas moves the ice through the conduit system 40. To provide still further gas flow into the ice trough 27, the ice maker 25 may include an opening 154 therethrough, which permits gas flow into the ice trough 27 through the ice maker 25 upon the engagement of the vacuum pump 50. The opening 154 is fitted with a filter 155 for filtering out unfavorable contaminants and particulates from the gas to ensure that the ice is not contaminated therefrom as the gas moves the ice through the conduit system 40. The ice maker including the opening therethrough and filter is similar to that described in U.S. patent application Ser. No. 09/364,794, entitled "Vacuum Pneumatic System for Conveyance of Ice" and assigned to Lancer Ice Link, LLC of Orange, Calif., incorporated herein by reference.

Illustratively, to operate the flow director system 1 of FIG. 4 so that ice passes through the discharge interface 32*a*, the gas flow gate assembly 100 creates a desired path across the conduit system 40. The flow gate controller 99 opens flow gate 10*b* and closes flow gate 10*a* to establish the desired path. Accordingly, the flow director system 1 applies a negative pressure, via the vacuum pump 50 and gas flow gate assembly 100, to draw gas through the ice trough 27 via the opening 150 and the openings 151 and 154, if included, across branch 42*b*', 42*d*, and 42*e*, and out dispensing outlet 49. Ice is thus drawn from ice trough 27 through interface aperture 27*c* in cooperative engagement with branch 42*b*' and carried to separator 31*a*. As a result of a negative pressure actively applied at interface aperture 27*c*, gas flow from branch 42*a*' is carried through the ice trough 27 from interface apertures 27*a*, the passive branch interface aperture, toward interface aperture 27*c* to prevent damage of the ice trough 27 as discussed above.

In a similar manner, to pass ice through the discharge interface 32*b* of FIG. 4, the flow gate controller 99 closes flow gate 10*b* and opens flow gate 10*a* to establish a desired path. The flow director system 1 thus applies a negative pressure to draw gas through the ice trough 27 via the opening 150 and the openings 151 and 154, if included, across branch 42*a*', 42*c*, and 42*e*, and out dispensing outlet 49. Ice is drawn from the ice trough 27 through the interface aperture 27*a* in cooperative engagement with 42*a*' and carried to separator 31*b*.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims that follow.

We claim:

1. A gas flow gate assembly for directing ice along a designated path defined by a conduit system, comprising:

a plurality of flow gates disposed along the conduit system for routing ice flow along the conduit system;

a flow gate controller linked to the plurality of flow gates for opening and closing the flow gates, thereby creating the designated path for directing ice along the conduit system; and a vacuum pump coupled with the conduit system, whereby the vacuum pump applies a negative pump pressure to the conduit system thereby drawing ice along the designated path.

2. The gas flow gate assembly according to claim 1 wherein the conduit system is coupled with an ice container for delivering ice to the conduit system.

3. The gas flow gate assembly according to claim 1 wherein the ice container is coupled with an ice maker for supplying ice to the ice container.

4. The flow director system according to claim 1 wherein the conduit system discharges ice to a desired locale.

5. A flow director system for transporting ice to desired locales, comprising:

a conduit system, the conduit system defining a first desired path for transporting ice and a second desired path for transporting ice;

an ice container for delivering ice into the conduit system, the ice container including a first interface aperture communicating with the first desired path and a second interface aperture communicating with the second desired path; and a gas flow gate assembly coupled with the conduit system for directing ice along either the first desired path or the second desired path.

6. The flow director system according to claim 5 wherein the gas flow gate assembly comprises:

a plurality of flow gates disposed along the conduit system for routing ice flow along the conduit system; and a flow gate controller linked to the plurality of flow gates for opening and closing the flow gates.

7. The flow director system according to claim 6 wherein the flow gate controller facilitates creation of either the first desired path for directing ice along the conduit system or the second desired path for directing ice along the conduit system.

8. The flow director system according to claim 5 wherein the ice container includes an opening for permitting gas flow into the ice container.

9. The flow director system according to claim 8 wherein the ice container includes a filter disposed over the opening.

10. The flow director system according to claim 5 further comprising an ice maker for supplying for supplying ice to the ice container.

11. The flow director system according to claim 10 wherein the ice maker includes an opening for permitting gas flow through the ice maker into the ice container.

12. The flow director system according to claim 11 wherein the ice maker includes a filter disposed over the opening.

13. The flow director system according to claim 5 wherein the ice container includes an ice transport element for drawing ice supplied from the ice maker through the ice container.

14. The flow director system according to claim 13 wherein the ice transport element comprises an auger.

15. The flow director system according to claim 13 wherein the ice transport element comprises a reversible auger.

16. The flow director system according to claim 5 further comprising a vacuum pump in cooperative engagement with the conduit system.

17. The flow director system according to claim 16 wherein the vacuum pump and the gas flow gate assembly cooperatively apply a pump pressure to the conduit system for moving ice therethrough.

18. The flow director system according to claim 16 further comprising a router coupled with the conduit system for selectively applying either a positive or a negative pump pressure to the conduit system.

19. The flow director system according to claim 16 further comprising a muffler in cooperative engagement with the vacuum pump.

20. The flow director system according to claim 16 wherein the flow gate controller operates on a pulse timing sequence to facilitate the delivery of negative and positive pump pressure into the conduit system.

21. The flow director system according to claim 5 further comprising a filter in cooperative engagement with the conduit system for ensuring ice is not contaminated by the gas flow that moves ice through the conduit system.

22. The flow director system according to claim 5 wherein the first interface aperture comprises an active branch interface aperture for operatively receiving a pump pressure.

23. The flow director system according to claim 5 wherein:

the first interface aperture comprises an active branch interface aperture; and the second interface aperture comprises a passive branch interface aperture.

24. The flow director system according to claim 23 wherein a gas flow is established across the ice container between the first and the second interface apertures.

25. The flow director system according to claim 24 wherein a negative pressure is applied to the first interface aperture, thereby establishing a gas flow across the ice container from the second interface aperture to the first interface aperture.

26. The flow director system according to claim 24 wherein a positive pressure is applied to the first interface aperture, thereby establishing a gas flow across the ice container from the first interface aperture to the second interface aperture.

27. The flow director system according to claim 5 further comprising an ice discharge unit in cooperative engagement with the conduit system.

28. The flow director system according to claim 27 wherein the ice discharge unit is positioned at a desired locale so that ice may be delivered thereto.

29. The flow director system according to claim 5 further comprising a plurality of ice discharge units positioned at different locales.

30. The flow director system according to claim 5 further comprising a drop-in ice bin in cooperative engagement with the conduit system for facilitating storage of large quantities of ice.

31. The flow director system according to claim 30 further comprising a pressure converter coupled with the conduit system in cooperative engagement with the drop-in ice bin for establishing positive pressure across the conduit system for discharge of ice into the drop-in ice bin.

32. A method for directing ice along a designated path defined by a conduit system, comprising the steps of:

positioning a plurality of flow gates along the conduit system;

coupling a vacuum pump with the conduit system;

linking a flow gate controller linked to the plurality of flow gates;

opening and closing the flow gates with the flow gate controller, thereby creating the designated path for directing ice along the conduit system; and applying via the vacuum pump a negative pump pressure to the conduit system thereby drawing ice along the designated path.

33. The method for directing ice according to claim 32 further comprising the steps of:

coupling an ice container with the conduit system;

coupling an ice maker with the ice container to supply ice thereto; and delivering ice from the ice container via ice the conduit system.

34. The method for directing ice according to claim 32 further comprising the step of discharging ice to a desired locale via the conduit system.

35. A method for transporting ice to desired locales, comprising the steps of: forming a flow director system, the flow director system, comprising:

a conduit system defining a first desired path for transporting ice and a second desired path for transporting ice, an ice container for delivering ice into the conduit system, the ice container including a first interface aperture communicating with the first desired path and a second interface aperture communicating with the second desired path, and a gas flow gate assembly coupled with the conduit system; and controlling the gas flow gate assembly to direct ice along either the first desired path or the second desired path.

36. The method for transporting ice according to claim 35, further comprising the steps of:

positioning a plurality of flow gates along the conduit system;

linking a flow gate controller with the plurality of flow gates; and opening and closing the flow gates with the flow gate controller, thereby creating either the first desired path for directing ice along a conduit system or the second desired path for directing ice along the conduit system.

37. The method for transporting ice according to claim 35, further comprising the steps of:

coupling a vacuum pump with the conduit system; and applying a pump pressure to the conduit system for moving ice through the conduit system.

38. The method for transporting ice according to claim 35, further comprising the steps of:

coupling an ice maker with the ice container to supply ice thereto; and delivering ice from the ice container via ice the conduit system.

39. The method for transporting ice according to claim 35, further comprising the step of channeling ice from the ice container to the conduit system via either the first or the second interface aperture.

40. The method for transporting ice according to claim 39 wherein the step of channeling ice from the ice container to the conduit system via either the first or the second interface aperture comprises the step of establishing a gas flow across the ice container between the first and the second interface apertures.

41. The method for transporting ice according to claim 40 wherein a negative pressure is applied to the first interface aperture, thereby establishing a gas flow across the ice container from the second interface aperture to the first interface aperture.

42. The method for transporting ice according to claim 35, further comprising the step of operating the flow gate controller on a pulse timing sequence to facilitate delivery of negative and positive pump pressure to the conduit system.

43. The method for transporting ice according to claim 35, further comprising the step of linking an ice discharge unit with the conduit system.

44. The method for transporting ice according to claim 43 wherein the step of linking an ice discharge unit with the conduit system, comprises the steps of:

positioning the ice discharge unit at a desired locale; and delivering ice to the desired locale via the ice discharge unit.

45. The method for transporting ice according to claim 35, further comprising the step of linking a drop-in ice bin with the conduit system.

46. The method for transporting ice according to claim 45 wherein the step of linking a drop-in ice bin with the conduit system, comprises the steps of:

positioning the drop-in ice bin at a desired locale; and delivering ice to the desired locale via the ice discharge unit.

* * * * *